US005530526A

United States Patent [19]

Kleckner et al.

[11] Patent Number: 5,530,526

[45] Date of Patent: Jun. 25, 1996

[54] MODULAR CHARGING DEVICE FOR IMAGING SYSTEM

[75] Inventors: Robert J. Kleckner, Westchester, N.Y.; Irena Makarchuk, Fairfield, Conn.; Frank Martines, Suffolk, N.Y.

[73] Assignee: Xerox Corporation, Stamford, Conn.

[21] Appl. No.: 434,962

[22] Filed: May 4, 1995

[51] Int. Cl.[6] ..... G03G 15/02

[52] U.S. Cl. ..... 355/219; 355/200; 361/225

[58] Field of Search ..... 355/219, 221, 355/222, 223, 224, 225, 226; 361/225, 229; 430/937, 902; 347/111, 112, 140, 141; 250/324, 325, 326

[56] References Cited

U.S. PATENT DOCUMENTS

| | | | |
|---|---|---|---|
| 2,864,756 | 12/1958 | Rothacker | 250/325 X |
| 3,675,010 | 7/1972 | Knechtel et al. | 250/326 |
| 3,967,959 | 7/1976 | Goffe et al. | 430/41 |
| 4,387,980 | 6/1983 | Ueno et al. | 355/219 |
| 4,558,221 | 12/1985 | Gundlach et al. | 250/325 |
| 5,073,434 | 12/1991 | Frank et al. | 428/195 |
| 5,351,111 | 9/1994 | Takafuji et al. | 355/221 |

FOREIGN PATENT DOCUMENTS

| | | | |
|---|---|---|---|
| 55-98767 | 7/1980 | Japan | 355/219 |

*Primary Examiner*—Joan H. Pendegrass
*Assistant Examiner*—Quana Grainger
*Attorney, Agent, or Firm*—Oliff & Berridge

[57] ABSTRACT

A modular charging device for use in a printing or imaging system includes a plurality of individual charging units and means for arranging the plurality of individual charging units together in a modular fashion. The modular charging device may be arc-shaped to uniformly charge a rotating drum or a circular belt, or may be linear to uniformly charge a linear imaging member.

18 Claims, 7 Drawing Sheets

MODULAR CHARGING DEVICE FOR IMAGING SYSTEM

BACKGROUND OF THE INVENTION

This invention relates to a modular charging device for use in printing and imaging systems. More particularly, the present invention relates to a modular charging device wherein a plurality of charger units are arranged together in a modular fashion. Such a modular charging device is useful in a wide variety of printing and imaging processes, such as in migration imaging, electrostatographic imaging, ionographic imaging, and the like.

A wide variety of printing and imaging systems and processes are known and described in the art. Among these various processes are migration imaging and ionographic imaging processes.

For example, U.S. Pat. No. 3,967,959 to Goffe et al. describes a migration imaging system and process. In the migration imaging process, a migration imaging member comprising a substrate, a softenable layer of migration marking material and an overlayer is electrically charged in an imagewise configuration prior to development of the image. The migration imaging member may be electrically charged by various means, including charging or sensitizing through a mask or stencil, shape electrodes, electron beam and numerous other techniques.

An example of an ionographic imaging system is disclosed in U.S. Pat. No. 5,073,434 to Frank et al. In the described ionographic imaging system, an electrostatic latent image is formed on a dielectric imaging member by various techniques such as by an ion stream, stylus, shaped electrode and the like. The electrostatic latent image is then developed by applying electrostatically charged marking particles to the imaging member, and transferring the marking particles to a substrate such as paper. In the ionographic imaging process, the imaging member is first charged by a charging apparatus, such as a corona discharge apparatus, to a uniform electrostatic charge, after which the imaging member is exposed in an imagewise fashion to selectively discharge the imaging member to form an electrostatic latent image. In the described process, the charging apparatus comprises a single corona discharge unit.

In the conventional printing and imaging processes, the imaging member is generally charged to a high electric potential, on the order of 1,000 volts, by a single charging unit. A benefit of precharging the imaging member to a high potential is to avoid problems associated with lower potentials being created on the imaging member surface by triboelectrification against components such as the cleaning blade and developer that are in contact with the surface of the imaging member. For example, triboelectric charging levels on the imaging member may reach levels near 600 volts in either polarity, depending on the imaging member thickness and on the materials chosen for the contacting subsystems. By choosing the precharge level higher than the highest triboelectric charge level, all image areas and triboelectric charge areas may be precharged to a uniform level by the precharging device.

However, a problem with conventional charging devices has been the phenomenon of edge deletion, which occurs at positions of the imaging member that are not adequately precharged to the desired high potential. A further problem with the conventional charging devices is the difficulty in providing linear charging devices of varying lengths.

SUMMARY OF THE INVENTION

The present invention provides a modular charging device for use in any of the various printing and imaging processes. The modular charging device of the present invention overcomes the above-described problems and disadvantages of the conventional charging devices.

Specifically, this invention provides a modular charging device for use in a printing or imaging system, comprising a plurality of individual charging units and means for arranging said plurality of individual charging units together in a modular fashion.

The modular charging device of the present invention is particularly useful in any of the various printing and imaging processes wherein an imaging member or other substrate is precharged to a uniform potential, either before or after development of an image. For example, the modular charging device of the present invention may be utilized in such imaging systems as migration imaging, electrostatographic imaging, ionographic imaging, and the like.

DETAILED DESCRIPTION OF PREFERRED EMBODIMENTS

Figure 1:
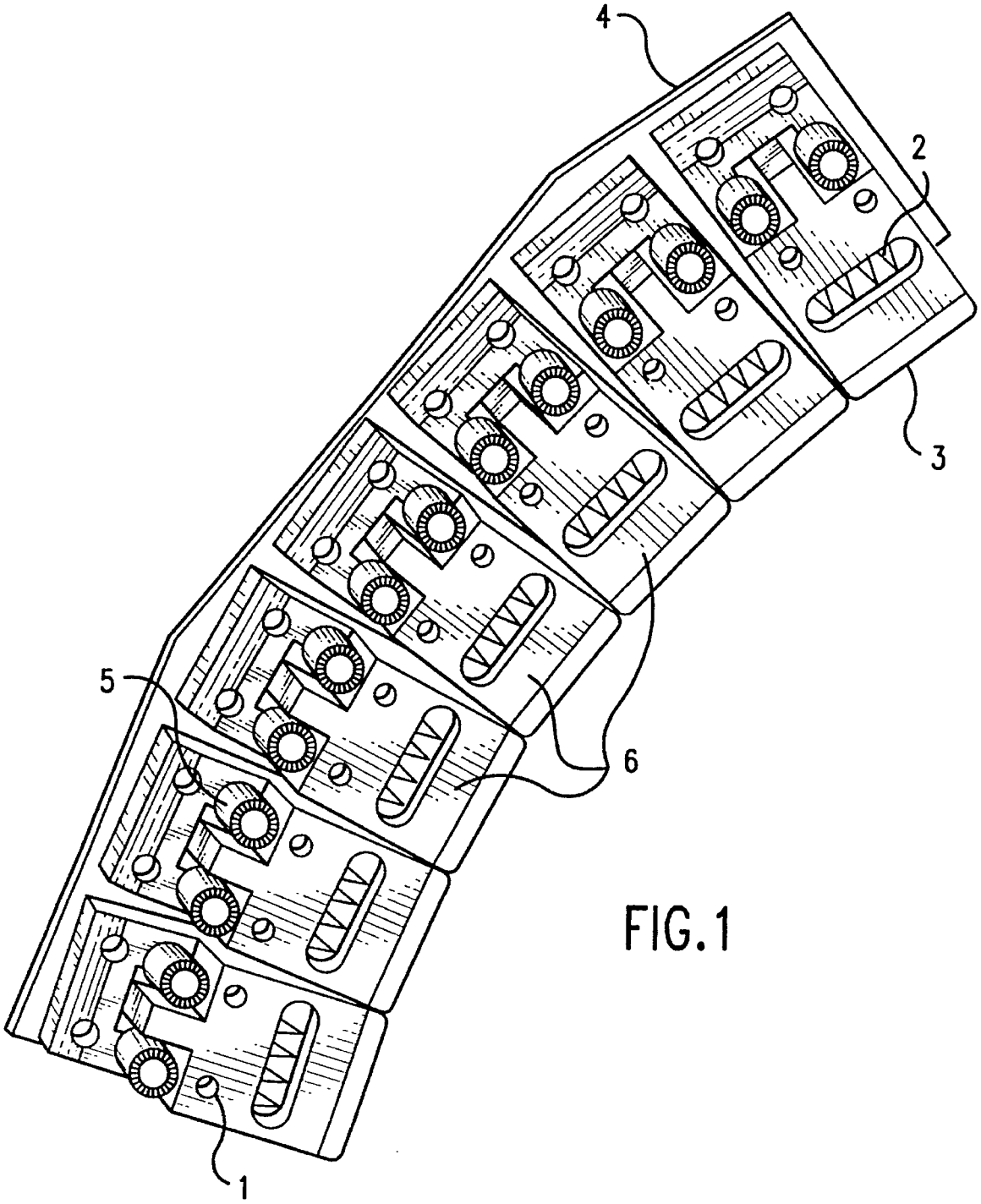
FIG. 1 shows a modular arc-shaped charging device comprising seven individual charging units.

The present invention provides a modular charging device that can be used in any of the various printing and imaging systems. Although various individual charging devices are well known in the art and have been extensively used in printing and imaging processes, it has not heretofore been known or possible to assemble a plurality of the individual charging devices (charging units) into a modular charging device. A major problem has been that a wide variety of diameters of imaging members exist for use in the various imaging processes, and therefore the production of an arc-shaped charging device would require that a separate charging device be developed for each of the wide-ranging imaging member diameters. Because the charging device is the most complex part of the charging subsystem, such individual development of an arc-shaped charging device for each particular system has been cost prohibitive.

Similarly, it has not been possible to provide charging devices of varying desired lengths for linear devices, due to the large variance in desired lengths. That is, for a linear imaging process, it was previously necessary to custom-design a single charging unit for the desired linear length.

The above-described problems and disadvantages are overcome in the present invention by providing a modular charging device that may be arranged in any desired configuration, such as in an arc-shaped or linear fashion. Generally, the modular charging device comprises a plurality of individual charging units mounted on a bracket, which in turn is appropriately connected to the remainder of the charging subsystem and/or the imaging system in general.

Individual charging units are well known in the art, and are not described in detail herein. However, for example, the charging units that may be utilized to form the modular charging device of the present invention may include any of the various known chargers and includes, but is not limited to, a corotron, scorotron, dicorotron, bias member, roller charger, and the like. Accordingly, any of the individual charging devices, such as corona discharge devices, previously used individually in an imaging system, may be combined as individual units of the modular charging device of the present invention.

For example, an example of an individual charging unit that may be utilized to form the modular charging device of the present invention is described in U.S. Pat. No. 5,351,111, the entire disclosure of which is incorporated herein by reference. This patent reference describes one of the many known corona discharge devices for uniformly charging a sensitive member.

In general, the plurality of individual charging units are connected together by using a bracket or other appropriate device. In most cases, the mounting bracket will be custom designed for each particular imaging apparatus. The design of the mounting bracket will depend, of course, upon such factors as the diameter of the imaging member, the desired degrees of arc of the resultant charger or the linear length of the imaging member, and the like. However, a benefit of the present invention is that the mounting bracket will be the only custom designed portion of the modular charging device. Although the mounting bracket is not particularly limited, the bracket will generally include means for attaching the mounting bracket to the charging subsystem of an imaging apparatus, means for attaching a plurality of charging units to the mounting bracket, and means for interconnecting the electrical components of the plurality of charging units. The charging units attached to the mounting bracket are equidistantly disposed from an image forming member.

In one embodiment of the present invention, the modular charging device is arc-shaped. The arc-shaped modular charging device may be used, for example, to charge the surface of a rotating drum or circular belt. In this embodiment, a mounting bracket is designed for the specific drum diameter or circular belt radius, and is provided with a plurality of charging units, thereby forming a modular arc-shaped charging device. If a different imaging member is inserted, having a different diameter, or if the radius of the circular belt is changed, the modular arc-shaped charging apparatus may be adjusted by merely incorporating a different mounting bracket.

In another embodiment of the present invention, the modular charging device may be used in a linear imaging process. Because the charging device is modular, the charging device may be adjusted to any desired length of the imaging member to be charged. Thus, for example, as the linear length of the imaging member is increased or decreased, the modular charging device may be accordingly adjusted by inserting or removing, respectively, individual charging units.

In yet a further embodiment of the present invention, the mounting bracket for the modular charging device is designed to permit the inclusion of multiple rows of individual charging units. Thus, for example, the mounting bracket is designed to include two or more rows of individual charging units, where the various rows may be staggered in relation to the adjoining row. This multiple row arrangement may, of course, be used in any of the embodiments of the present invention, including in the arc-shaped and linear modular charging devices.

In the present invention, the modular charging device is not particularly limited to use in the main charging subsystem of the printing or imaging system. Rather, the modular charging device may be used in any of the applications in which corona discharge units are typically used. For example, the modular charging device may also be used as a corona generating device that sprays ions onto the back side of a support material to attract the toner powder image from the surface of the rotating drum or circular belt to the support material, or may be used as a pre-clean corona generating device to neutralize the charge attracting the particles to the surface or the rotating drum or circular belt.

DETAILED DESCRIPTION OF THE DRAWINGS

Figure 4:
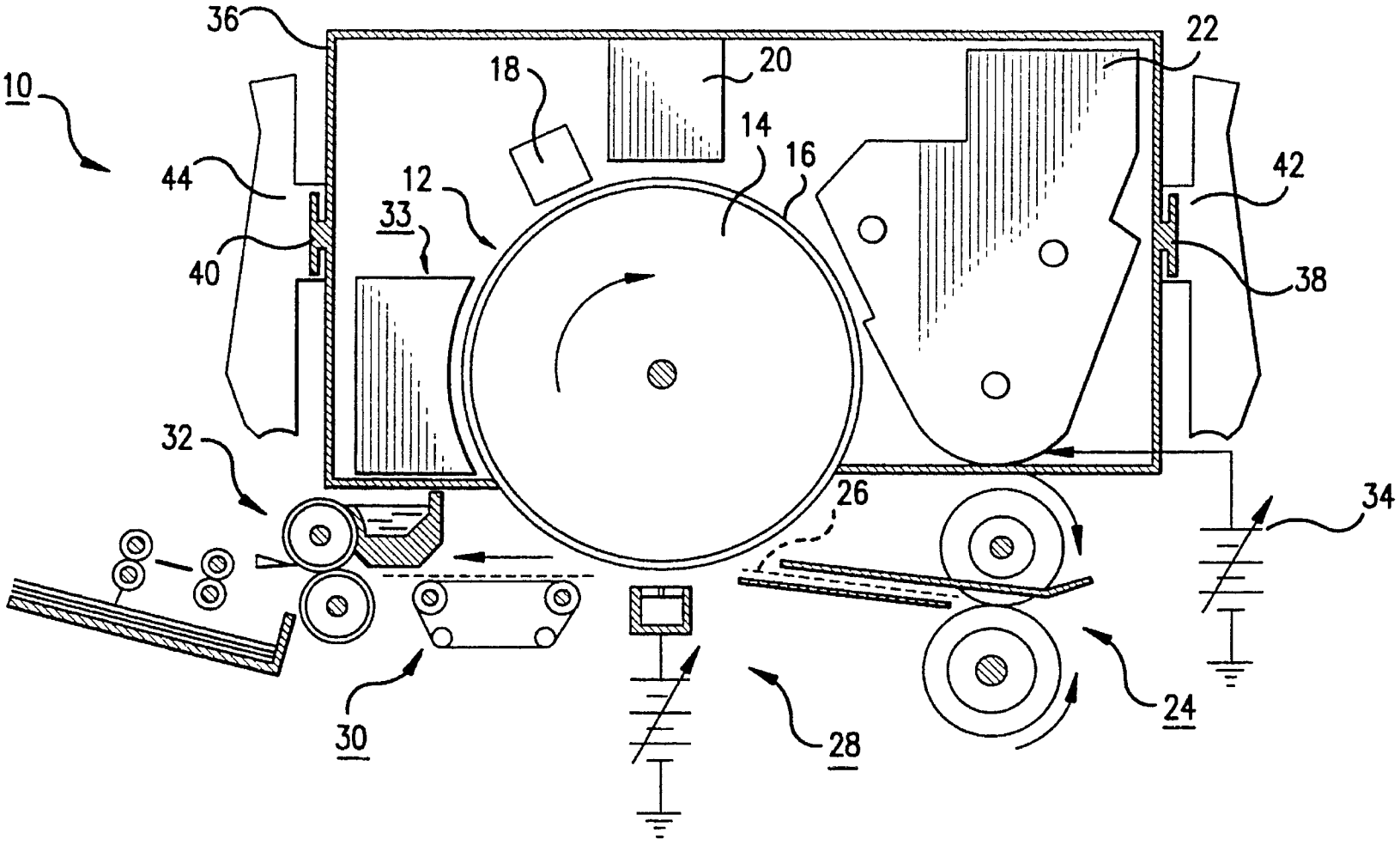
FIG. 4 PRIOR ART
FIG. 4 is a partial sectional elevation view showing a prior art printing apparatus utilizing a single charging device.
Figure 5:
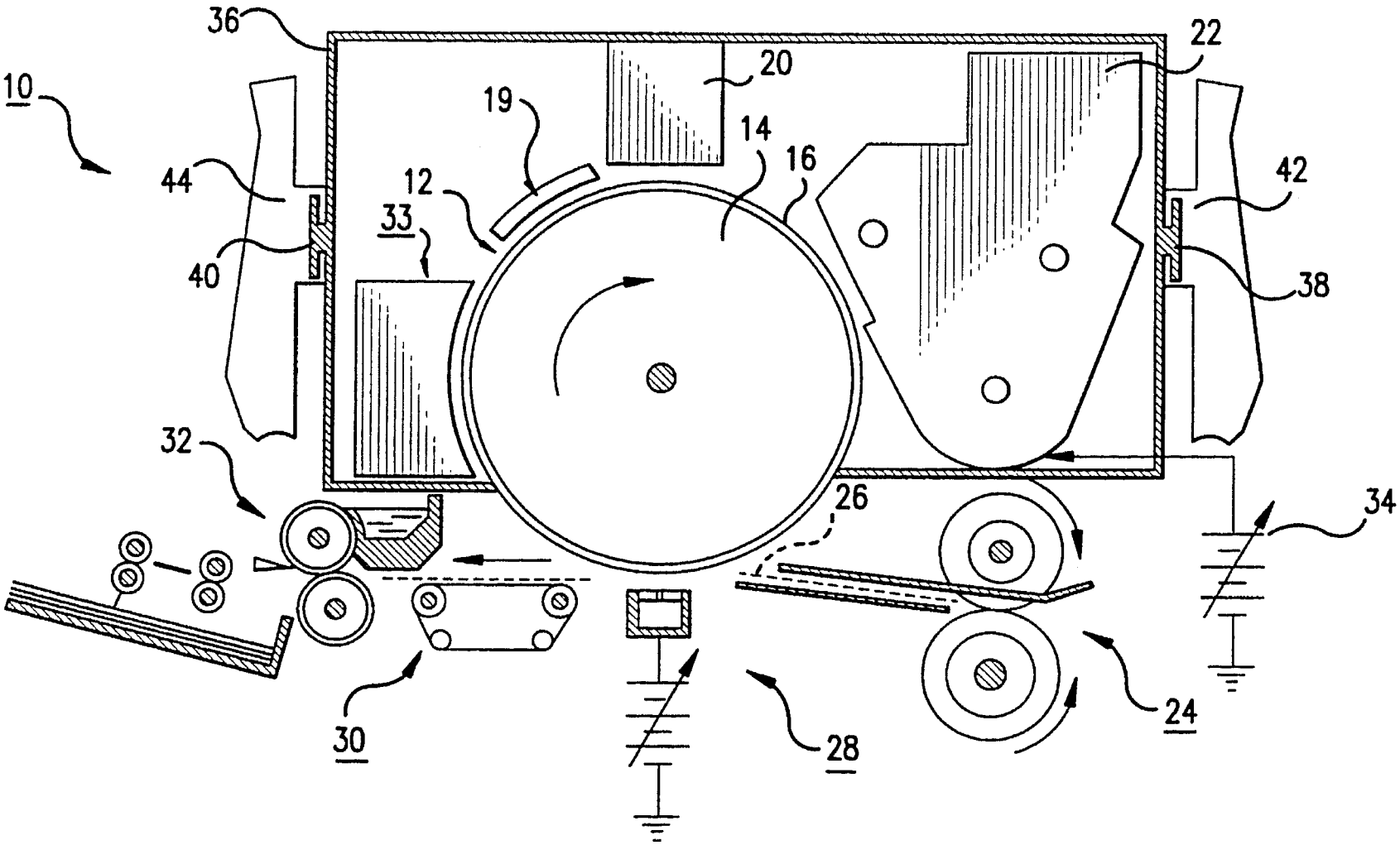
FIG. 5 is a partial sectional elevation view showing a printing apparatus utilizing a modular charging device of the present invention.

The present invention will now be described in more detail with reference to the figures. It will become evident from the following discussion that the modular charging device of the present invention is equally well suited for use in a wide variety of printing and imaging systems, as well as in different aspects of the various imaging systems. Because the various processing stations and elements employed in the charging units of FIGS. 1–3 and imaging systems of FIGS. 4–5 are well-known, they are shown schematically and their operation will be described only briefly. In the drawings, like reference numerals are used throughout to designate like elements.

FIG. 1 depicts an arc-shaped modular charging device of the present invention. The modular charging device comprises a rigid mounting bracket 4, which is custom designed for a specific imaging member diameter and charging arc length. To the mounting bracket are attached, by any suitable means, multiple individual charging units 6. In this FIG. 1, seven individual charging units are attached to the mounting bracket 4. As well-known in the art, the individual charging units generally comprise a housing 1 that supports the electrical components, maintains the mechanical tolerances and mounts the individual charging unit 6 to the bracket 4. Within the housing 1 is contained an electrode 2, designed to create a corona discharge when raised to a sufficiently high voltage and which can be a wire, pin array, and the like, as known to one skilled in the art. The housing 1 also generally includes a controller 3 that limits the charge applied to the surface of the imaging member, and electrical interconnects 5 that enable the application of voltage to the controller 3 and to the electrode 2. In this FIG. 1, the controller 3 may be a screen, a slotted plate, etc., as known to one skilled in the art. The mounting bracket 4 also includes means (not shown) for connecting the entire modular arc-shaped charging device to the charging subsystem or other portion of an imaging apparatus.

Figure 2:
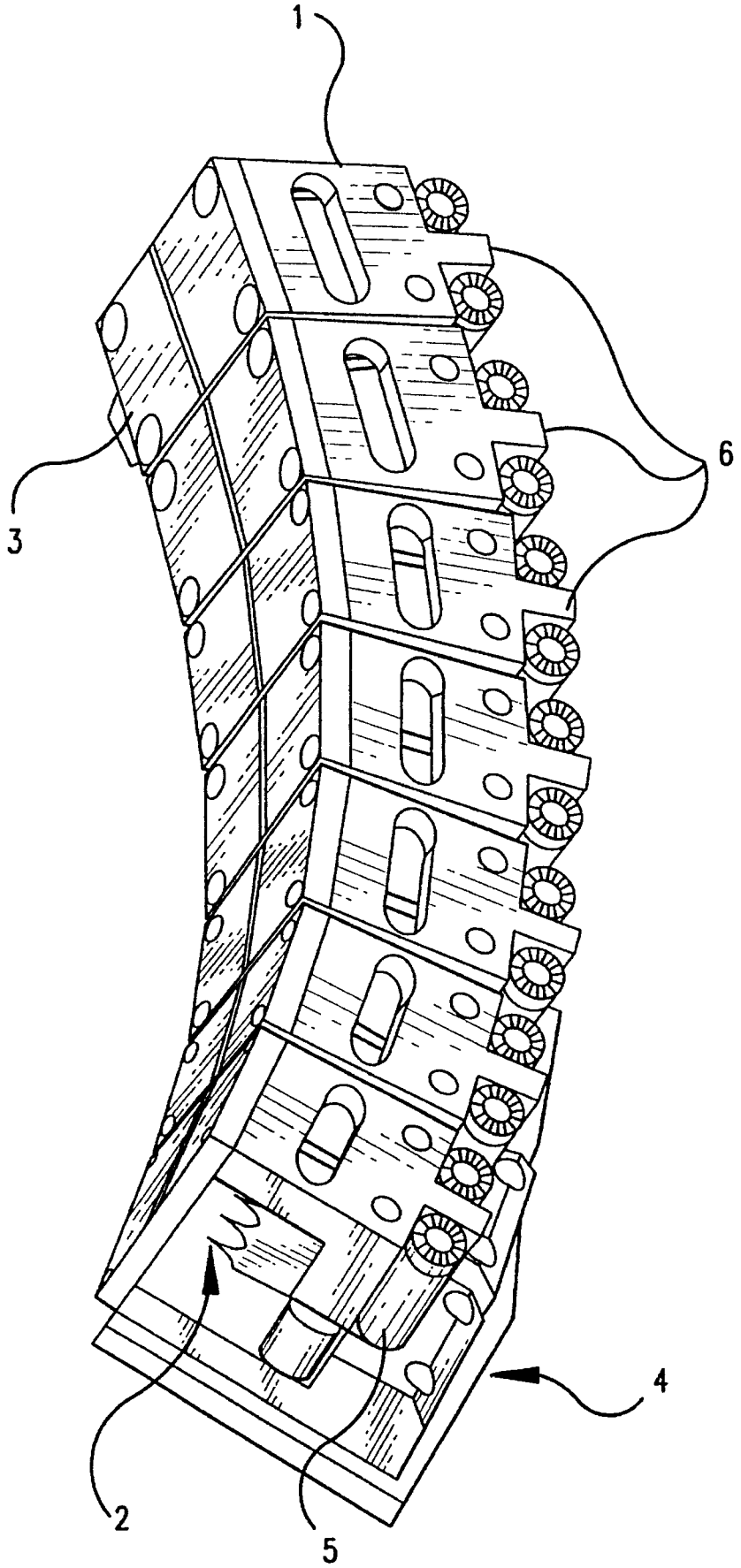
FIG. 2 is a perspective view of the arc-shaped charging device of FIG. 1.

FIG. 2 is a perspective view of the modular arcshaped charging device of FIG. 1. FIG. 2 shows the same seven charging units 6 attached to mounting bracket 4.

Figure 3:
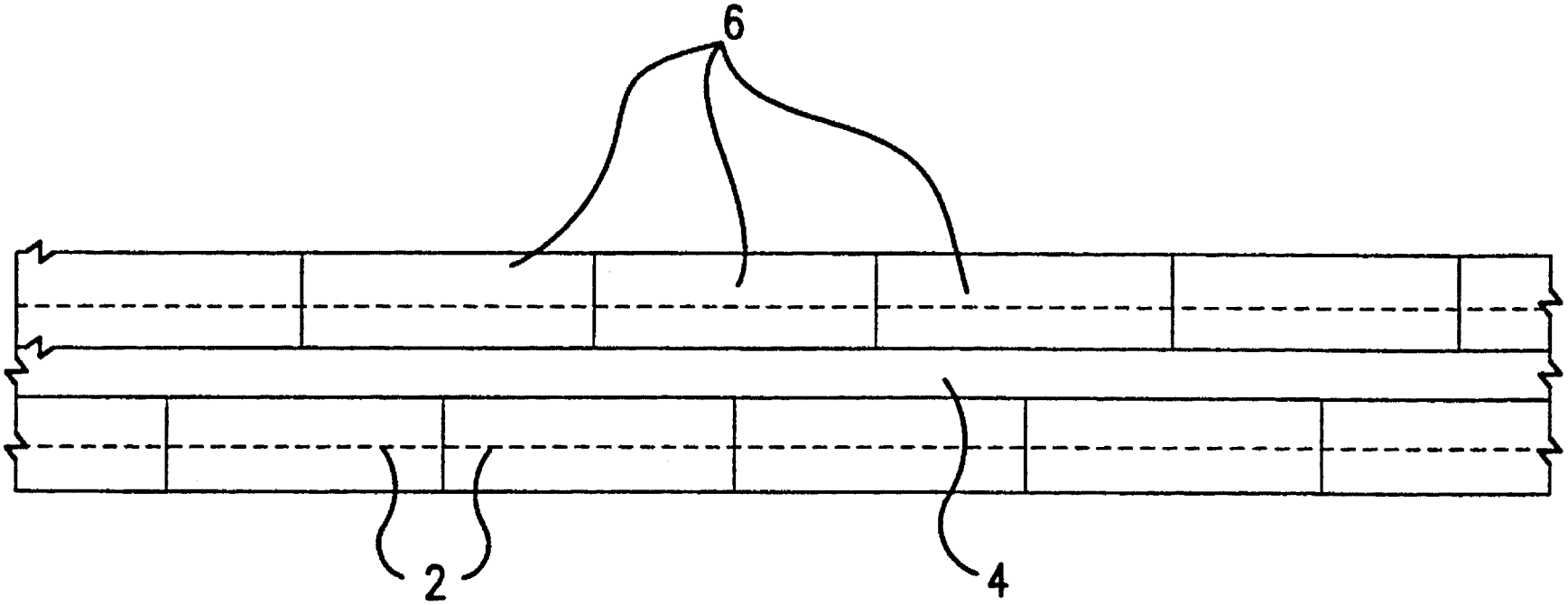
FIG. 3 shows a modular linear charging device comprising nine individual charging units.

FIG. 3 depicts an embodiment of the present invention wherein the modular charging device comprises a plurality of individual charging units 6 attached to mounting bracket 4 and arranged in two linear rows. The Figure is a perspective view from the bottom of the charging units, looking directly at the electrodes. In FIG. 3, the individual charging units 6 are arranged such that one linear row is staggered in relation to the adjoining linear row.

FIG. 4 depicts a prior art imaging apparatus used in an ionographic imaging system. In FIG. 4, the printing system 10 comprises an electrographic imaging member 12 comprising an electrically conductive drum 14 having thereon a dielectric imaging layer 16. Arranged around the outer periphery of electrographic imaging member 12 is a charging station 18 for applying a uniform electrostatic charge to dielectric imaging layer 16; a fluid flow assisted ion projection printing head 20 for selectively discharging the uniformly charged dielectric imaging layer 16 to form an electrostatic latent image; a development station 22 for contacting the electrostatic latent image with a two-component developer to form a toner image in conformance with the electrostatic latent image; a sheet feeding station 24 to feed receiving sheets (shown as a dashed lined 26) to dielectric imaging layer 16; a transfer station 28 to transfer the toner image to receiving sheets 26; a sheet transport station 30 to transport receiving sheets 26 bearing the transferred toner image to a fusing station 32 for fixing the toner image to receiving sheets 26; and cleaning station 33 for removing any residual toner remaining on the imaging layer 16. An adjustable biasing power supply 34 is connected to development station 22 to permit changes to image development conditions relative to the latent image potential. By introducing a reverse bias, of the same polarity as the ions forming the latent image, and applying the bias between the conductive drum 14 and the development station 22, non-uniformities in the non-image areas of the latent image can be kept more free of unwanted toner particles. Except for an opening at the bottom, cassette housing 36 surrounds and supports the electrographic imaging member 12, charging station 18, printing head 20, development station 22, and cleaning station 33. The bottom of cassette housing 36 is open to allow imaging layer 16 to contact receiving sheets 26. Rails 38 and 40 are secured to the sides of and support cassette housing 36 and are adapted to be slideably mounted in horizontal tracks 42 and 44, respectively, which are, in turn, secured to frame members of the imaging device. This prior art imaging system is described in more detail in U.S. Pat. No. 5,073,434, the entire disclosure of which is incorporated herein by reference.

In FIG. 4, the charging station 18 comprises a single charging unit, such as a corona charging device.

FIG. 5 depicts an embodiment of the ionographic imaging system of FIG. 4, but modified to include the modular charging device of the present invention. In FIG. 5, the single-unit charging station 18 is replaced by a modular charging device 19 of the present invention. For example, the charging station 19 in FIG. 5 may include the modular charging device depicted in FIG. 3.

Figure 6:
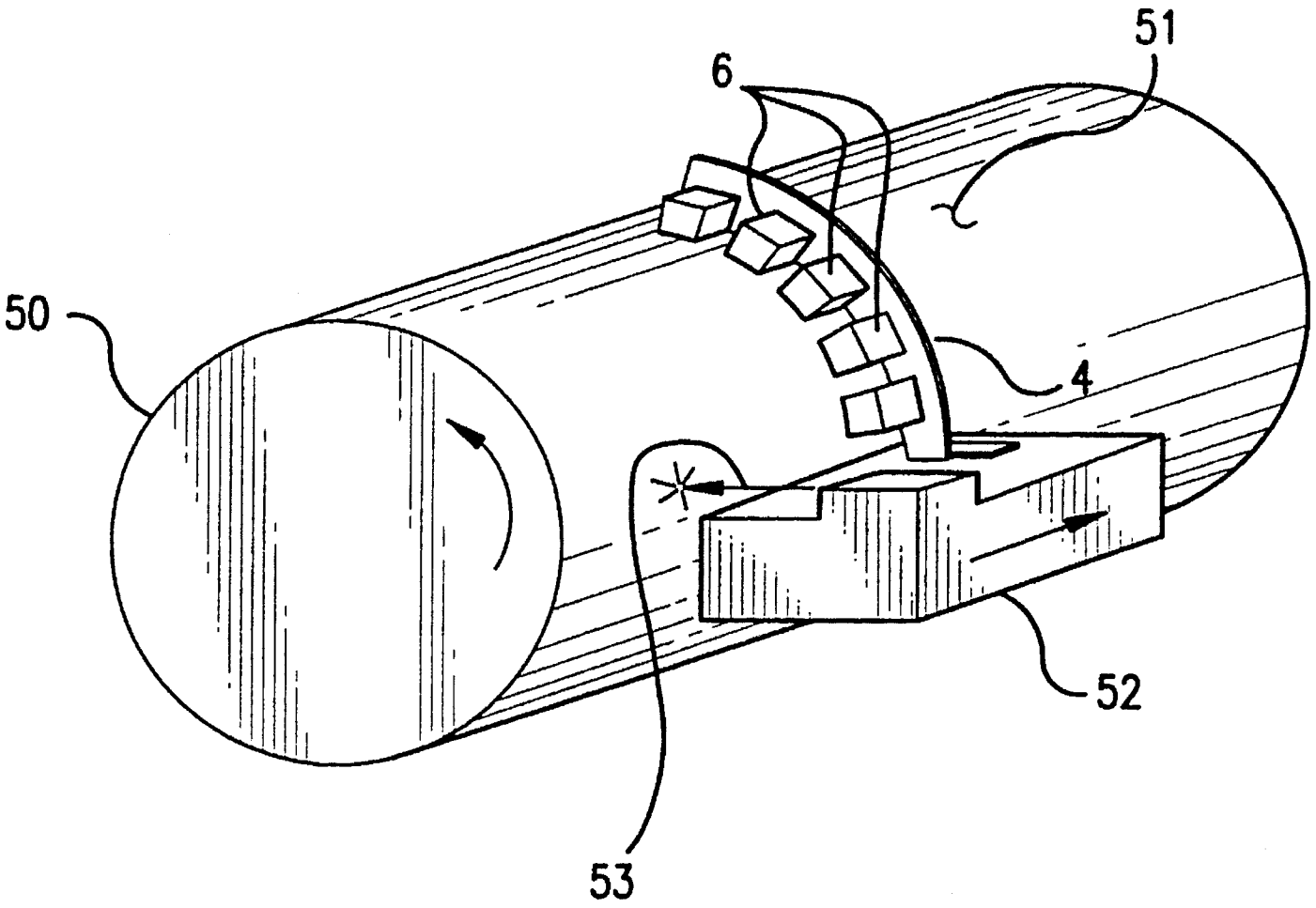
FIG. 6 shows an embodiment of the present invention with a modular arc-shaped charging device being used with an external drum recording device.

FIG. 6 shows an embodiment of the modular arc charger of the present invention. Here, the charger is employed with an external drum recording device that is used to expose Xerox digital film. In this device, the film is mounted to the external surface of a drum 51. The drum 50, with film mounted to its surface, rotates about its centerline. A laser 53 is mounted to a scanner carriage 52. While the drum rotates, the scanner carriage moves parallel to the axis of the drum and the image is created in a barber pole fashion. The modular arc-shaped charger device is mounted to the scanner carriage by means of a bracket 4. In this depiction, five modular charging units 6 are shown. As the drum rotates, the modular arc charger applies a charge to the surface of the digital film thereby making it sensitive to laser light. The laser 53 then exposes the film and creates a latent image. In these applications, the drum may have a diameter that varies over a wide range. The modular arc-shaped charger may be adapted to each application by incorporating a different mounting bracket.

In embodiments, the external drum recorder may also contain, for example, a device that uses radiant heat to desensitize Xerox digital film and allow daylight film handling, for example as described in copending U.S. patent application No. 08/434,961, entitled "A Device that uses Radiant Heat to Desensitize Migration Imaging Film and Allow Daylight Film Handling" and the entire disclosure of which is incorporated herein by reference.

Figure 7:
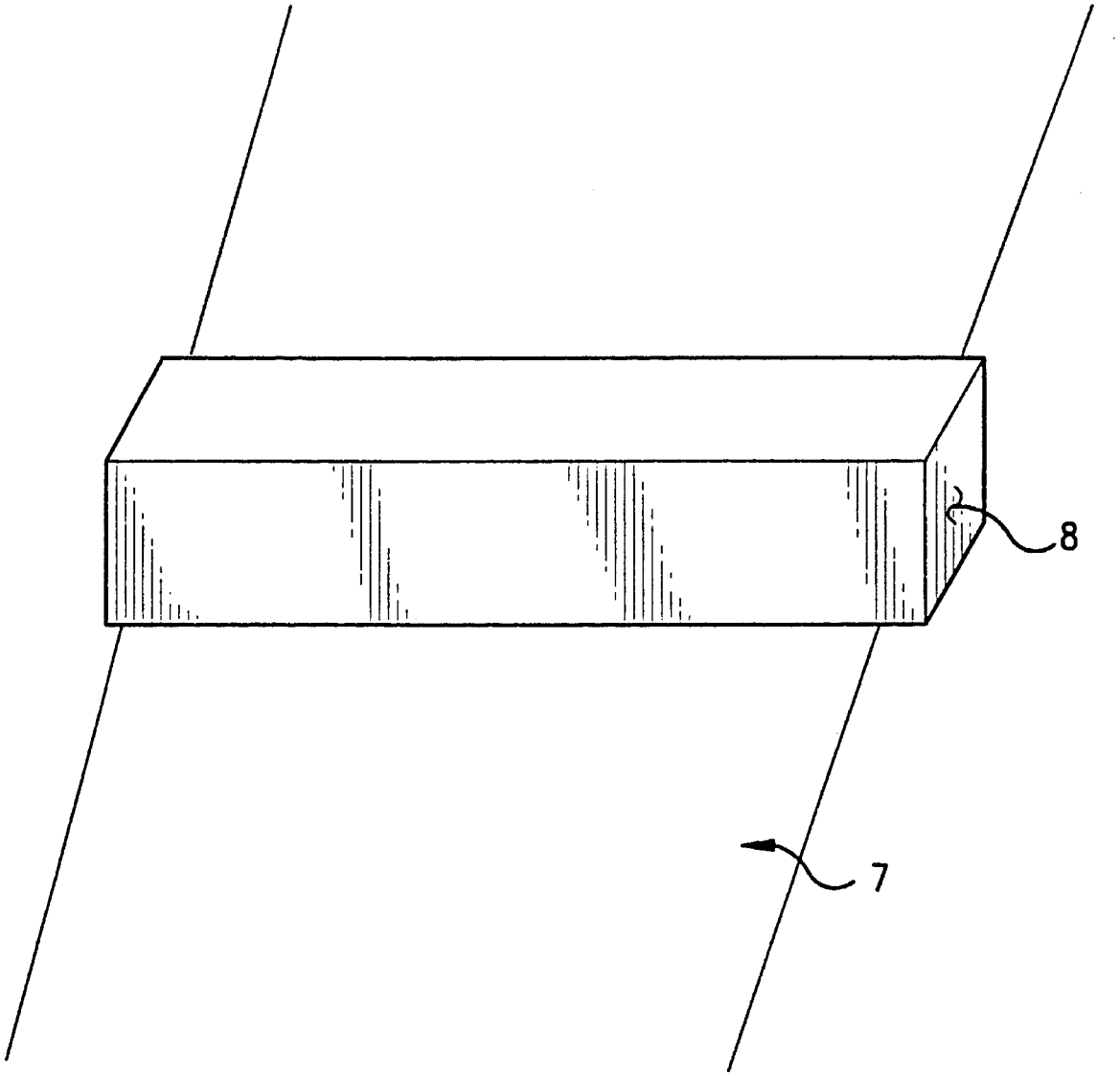
FIG. 7 shows the modular linear charging device of FIG. 3 being used with a planar imaging member.

FIG. 7 depicts the modular linear charging device of FIG. 3, indicated as charging unit 8, being used with a planar imaging member 7.

One skilled in the art will recognize that the above modular charging device and printing and imaging systems may be altered and adjusted as necessary to achieve desired and optimum results without departing from the spirit and scope of the invention as defined by the appended claims.

What is claimed is:

1. A modular charging device for use in a printing or imaging system, comprising a plurality of individual charging units attached to a bracket, said bracket comprising means for attaching the bracket to a charging subsystem of a printing or imaging apparatus and means for interconnecting electrical components of the plurality of individual charging units.

2. The modular charging device according to claim 1, wherein said plurality of individual charging units are selected from the group consisting of corotron, scorotron, dicorotron, bias member, and roller charger.

3. The modular charging device according to claim 1, wherein said plurality of individual charging units each comprise a housing, an electrode, a voltage controller and electrical interconnects.

4. The modular charging device according to claim 1, wherein said modular charging device is an arc-shaped modular charging device comprising two or more individual charging units.

5. The modular charging device according to claim 1, wherein said modular charging device is an arc-shaped modular charging device comprising three or more individual charging units.

6. The modular charging device according to claim 1, wherein said modular charging device is an arc-shaped modular charging device comprising four or more individual charging units.

7. The modular charging device according to claim 1, wherein said modular charging device is a linear modular charging device comprising two or more individual charging units.

8. The modular charging device according to claim 1, wherein said modular charging device is a linear modular charging device comprising two or more rows of individual charging units, each row comprising two or more individual charging units.

9. An imaging device, comprising:

a) an image forming member;

b) a modular charging device comprising a plurality of individual charging units attached to a bracket, said bracket comprising means for attaching the bracket to a charging subsystem of a printing or imaging apparatus and means for interconnecting electrical components of the plurality of individual charging units, wherein said individual charging units are equidistantly disposed from said image forming member;

c) means for forming an electrostatic latent image on said image forming member;

d) means for developing said electrostatic latent image on said image forming member; and e) means for transferring said developed image to a receiving substrate and fixing it thereto.

10. The imaging device according to claim 9, wherein said image forming member is a rotating drum.

11. The imaging device according to claim 9, wherein said image forming member is an electrostatographic imaging member.

12. The imaging device according to claim 9, wherein said image forming member is an ionographic imaging member.

13. The imaging device according to claim 9, wherein said image forming member is a planar imaging member.

14. The imaging device according to claim 9, wherein said plurality of individual charging units-are selected from the group consisting of corotron, scorotron, dicorotron, bias member, and roller charger.

15. The imaging device according to claim 9, wherein said modular charging device is an arc-shaped modular charging device comprising two or more individual charging units.

16. The imaging device according to claim 9, wherein said modular charging device is a linear modular charging device comprising two or more individual charging units.

17. The imaging device according to claim 9, wherein said image forming member comprises a drum and a film mounted to the external surface of said drum.

18. A modular charging device for use in a printing or imaging system, comprising a plurality of individual charging units and means for arranging said plurality of individual charging units together in a modular fashion, wherein said modular charging device is an arc-shaped modular charging device comprising four or more individual charging units.

* * * * *